US005929563A

United States Patent [19]

Genz

[11] Patent Number: 5,929,563

[45] Date of Patent: Jul. 27, 1999

[54] METAL HALIDE HIGH PRESSURE DISCHARGE LAMP

[75] Inventor: Andreas Genz, Berlin, Germany

[73] Assignee: Patent-Treuhand-Gesellschaft fuer elektrische Gluehlampen mbH, Munich, Germany

[21] Appl. No.: 08/949,546

[22] Filed: Oct. 14, 1997

[30] Foreign Application Priority Data

Nov. 7, 1996 [DE] Germany ..... 196 45 959

[51] Int. Cl.[6] ..... H01J 61/12; H01J 61/82

[52] U.S. Cl. ..... 313/571; 313/639; 313/640; 313/641

[58] Field of Search ..... 313/638, 639, 313/640, 641, 642

[56] References Cited

U.S. PATENT DOCUMENTS

| | | | |
|---|---|---|---|
| 3,514,659 | 5/1970 | Gungle et al. | 313/184 |
| 3,852,630 | 12/1974 | Wesselink et al. | 313/228 |
| 5,698,948 | 12/1997 | Caruso | 313/638 |

FOREIGN PATENT DOCUMENTS

| | | | |
|---|---|---|---|
| 0702394 | 3/1996 | European Pat. Off. | H01J 61/12 |
| 2270673 | 12/1975 | France | H01J 61/12 |
| 3920675 | of 0000 | Germany | H01J 61/86 |
| 23629232 | 8/1975 | Germany | H01J 61/20 |
| WO9528733 | 10/1995 | WIPO | H01J 61/12 |

OTHER PUBLICATIONS

Patent Abstracts of Japan, No. 55037701.

*Primary Examiner*—Nimeshkumar D. Patel
*Attorney, Agent, or Firm*—William H. McNeill

[57] ABSTRACT

A metal-halide high-pressure discharge lamp (1) with a discharge vessel (2) and two electrodes (4, 5) has inside discharge vessel (2) an ionizable filling, which contains yttrium (Y) in addition to inert gas, mercury, halogen, thallium (Tl), hafnium (Hf), whereby hafnium can be replaced wholly or partially by zirconium (Zr), dysprosium (Dy) and/or gadolinium (Gd) as well as, optionally, cesium (Cs). Preferably, the previously conventional quantity of the rare-earth metal is partially replaced by a molar equivalent quantity of yttrium. With this filling system, a relatively small tendency toward devitrification is obtained even with high specific arc powers of more than 120 W per mm of arc length or with high wall loads. Thus, the filling quantity of cesium can be clearly reduced relative to a comparable filling without yttrium, whereby an increase in the light flux and particularly in the brightness can be achieved.

11 Claims, 1 Drawing Sheet

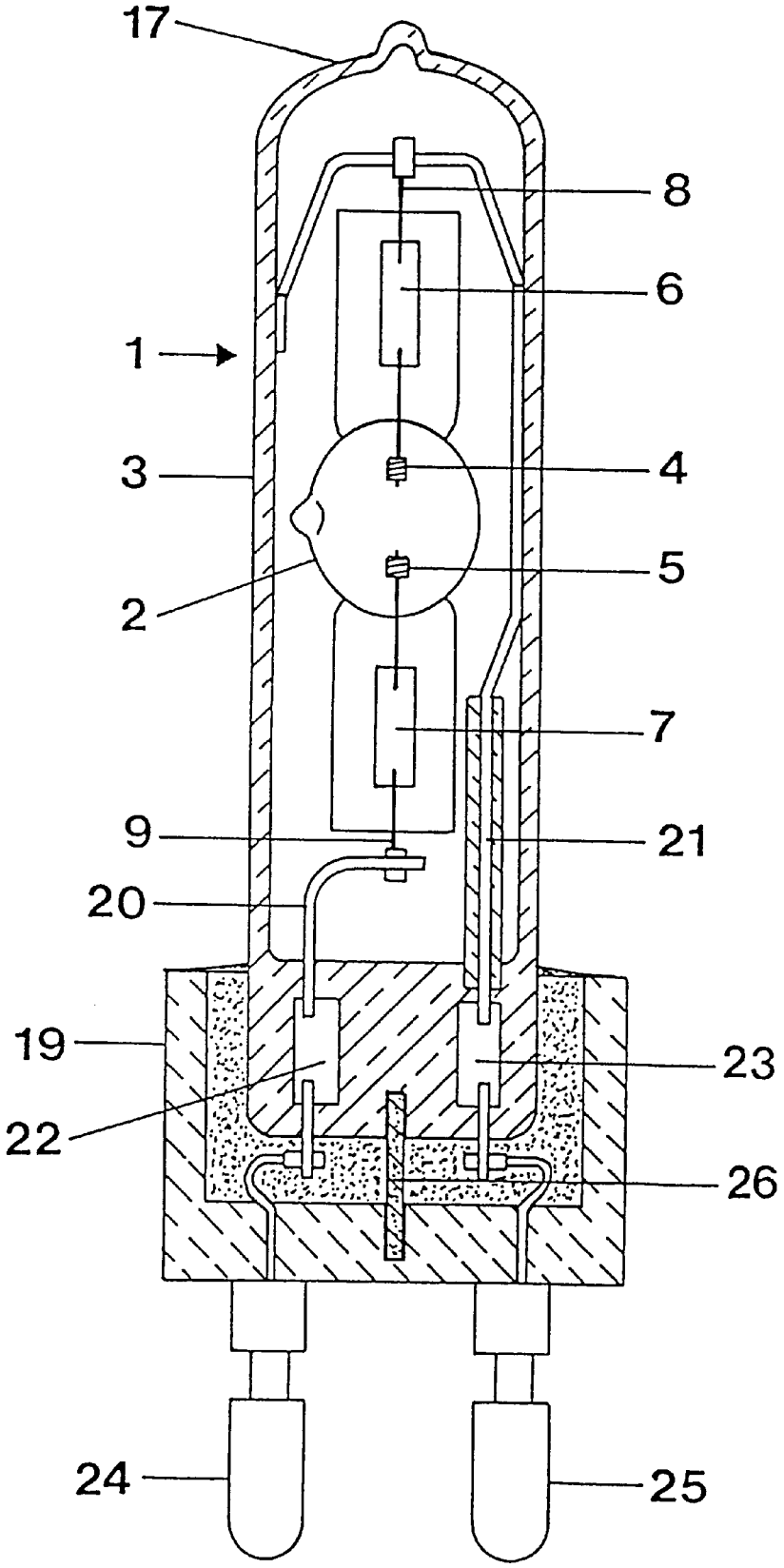
17
8
6
1
3
4
5
2
7
9
21
20
19
23
22
26
24
25

METAL HALIDE HIGH PRESSURE DISCHARGE LAMP

TECHNICAL FIELD

The invention relates to discharge lamps and more particularly to metal-halide high-pressure discharge lamps.

Among other things, such lamps are characterized by a good to very good color rendition ($R_a \geqq 80$) and color temperatures in the range between approximately 4000 K and 7000 K. These values are obtained with luminous powers of typically more than 70 lm/W. These lamps are therefore suitable both for all-purpose lighting as well as for special lighting purposes, e.g., projection techniques, effect and stage lighting, as well as for photo, film, and TV recording. The electrical power consumption amounts to between approximately 35 W and 5000 W. Typical power steps for all-purpose lighting are 150 W and 400 W. For special lighting, e.g., video projection, as a rule higher wattages are necessary, typically 575 W and more.

STATE OF THE ART

A metal-halide high-pressure discharge lamp is known that has an ionizable filling, consisting of inert gas, mercury, halogen, the elements thallium (Tl), cesium (Cs) and hafnium (Hf) for the formation of halides, whereby Hf can be replaced wholly or also partially by zirconium (Zr), as well as the rare-earth metals (RE) dysprosium (Dy) and/or gadolinium (Gd).

DISCLOSURE OF THE INVENTION

It is the task of the present invention to create a metal-halide high-pressure discharge lamp which has a color temperature between 4000 K and 7000 K, a color rendition index $R_a$>80 and at the same time an improved devitrifying behavior.

Another objective is an increase in luminous flux and particularly brightness.

These objects are achieved, in one aspect of the invention, by the provision of a metal-halide high-pressure discharge lamp (1) with a discharge vessel (2), two electrodes (4, 5) and an ionizable filling, which contains at least one inert gas, mercury, at least one halogen, and the following elements for the formation of halides: thallium (Tl), hafnium (Hf), whereby hafnium can be wholly or partially replaced by zirconium (Zr), as well as both, or one of the two, rare-earth metals (RE) dysprosium (Dy) and/or gadolinium (Gd), together with yttrium (Y).

The basic concept of the invention consists of adding yttrium (Y) in a targeted manner to the filling. It has been shown that the tendency toward devitrification can be reduced by this measure. The utilized luminous flux is reduced with increasing operating time of the lamp by devitrification of the lamp bulb, i.e., by the conversion from the glassy to the crystalline state. In addition, increasing devitrification reduces the service life, since the lamp bulb loses stability.

Further, the addition of yttrium opens up the possibility of reducing the quantity of cesium in the filling, or dispensing with cesium as a filling component entirely. This advantageous aspect of the invention is important for projection lamps. If the quantity of cesium is reduced in the filling, then on the one hand, the luminous flux is increased. On the other hand, the discharge arc increasingly contracts. Consequently, the brightness of the discharge arc that is important in projection techniques increases overproportionally in comparison to the increase in luminous flux. With this background, it is obvious that there is a great advantage of being able to reduce the filling quantity of cesium or in fact to dispense with cesium altogether, based on the addition of a corresponding quantity of yttrium.

A reduction in the filling quantity of cesium is desirable in and of itself since the light flux is reduced due to the cesium component in the filling. In the state of the art, however, this measure led unavoidably to a rapid and clear devitrification of the discharge vessel and was consequently not yet practical. Only by the addition of yttrium according to the invention is it generally possible to reduce the cesium component in highly loaded metal-halide discharge lamps, without unacceptably increasing devitrification at the same time.

For the case when cesium is entirely omitted in the filling, of course, an increased devitrification tendency must be taken into the bargain in the case of lamps with the yttrium addition according to the invention. Thus, cesium-free fillings will be selected only if maximum values for luminous flux and brightness have the highest priority.

In addition to the already named yttrium as well as the optional cesium, the ionizable filling of the discharge vessel also contains the following other elements for formation of the corresponding halides: thallium (Tl), hafnium (Hf), whereby the Hf can be entirely or partially replaced by zirconium (Zr), as well as both, or one of the two, rare-earth metals (RE) dysprosium (Dy) and/or gadolinium (Gd). Further, the filling still contains at least one inert gas, mercury (Hg) and at least one halogen. Preferably iodine (I) and/or bromine (Br) are used as halogens for forming the halides. The inert gas, e.g., argon (Ar) with a typical filling pressure of the order of magnitude of up to approximately 40 kPa serves for igniting the discharge. The desired arc-drop voltage is typically adjusted by Hg. Typical quantities for Hg lie in the range between approximately 10 mg and 30 mg per $cm^3$ of vessel volume for arc-drop voltages between 50 V and 100 V.

The molar filling quantities of Tl, Dy and, if necessary Gd typically amount to up to 15 $\mu$moles, up to 30 $\mu$moles or up to 0.6 $\mu$mole per $cm^3$ of vessel volume, respectively. The molar filling quantity of Hf and/or Zr lies in the region between 0.005 $\mu$moles and 35 $\mu$mole, preferably in the region between 0.05 $\mu$mole and 5 $\mu$moles per $cm^3$ of volume of the discharge vessel. The filling quantity of the optional Cs amounts to up to 30 $\mu$moles per $cm^3$ of the vessel volume, if needed.

A small devitrification tendency is produced with this filling system, despite high specific arc powers (typically>approximately 60 W per mm of arc length, particularly approximately 140 W per mm of arc length) or high wall loads.

A further advantage of the invention is the possibility of utilizing the effect of yttrium, first of all, for a net reduction in the devitrification tendency with otherwise unchanged light-technical properties, depending on the requirements of the lamp. On the other hand, however, the luminous flux or the brightness can be increased, with an otherwise unchanged tendency toward devitrification. It is also possible to take an intermediate path.

In the first variant, a part of the quantity of rare-earth metal that is common without yttrium, e.g. dysprosium, is replaced by a molar equivalent quantity of yttrium. Typical molar ratios between yttrium (Y) and the rare-earth metal(s) (RE) lie in the range of 0.5<Y/RE<2. It is preferred that 50% of the quantity of the rare-earth metal or metals be replaced by a molar equivalent of yttrium. The molar ratio between yttrium and the rare-earth metal(s), e.g. dysprosium, thus preferably amounts to one.

In the case of the second variant, the quantity of cesium that is usual without yttrium is also reduced such that the devitrification tendency remains unchanged when compared with the filling without yttrium. Typically, the quantity of cesium can be reduced overproportionally in a molar comparison to the quantity of yttrium added.

For example, it has proven suitable to replace 50% of the quantity of rare-earth metal that has been common up to the present time by a molar equivalent of yttrium, and to cut in half the previously common quantity of cesium.

The discharge vessel is preferably operated within an outer bulb, which is evacuated for a particularly good color rendition. In order to increase the service life, the outer bulb contains a gas filling, for example, up to 70 kPa nitrogen ($N_2$) or up to 40 kPa carbon dioxide ($CO_2$), whereby the color rendition is, of course, somewhat reduced.

DESCRIPTION OF THE DRAWING

The invention is explained more closely in the following on the basis of an example of embodiment. Here:

The FIGURE shows the structure of a high-pressure discharge lamp for projection purposes with a base on one side and with a discharge vessel sealed on both sides and a power consumption of 575 W.

BEST MODE FOR CARRYING OUT THE INVENTION

A 575-W lamp 1 for projection purposes is schematically shown in the FIGURE. It consists of a discharge vessel 2 sealed on both sides and made of quartz glass, which is enclosed by a cylindrical evacuated outer bulb 3 with a base on one side. One of the ends of outer bulb 3 has a rounded cap 17, and, on the other hand, the other end has a pinch seal and is cemented in a plug-in base 19 (G22 type). The electrodes 4, 5 which stand opposite each other at a distance of 4 mm, are sealed in a gas-tight manner in discharge vessel 2 by means of molybdenum foils 6, 7. The current leads 8, 9 are each connected to the first ends of two solid lead wires 20, 21. The second ends of lead wires 20, 21 are pinched in the foot of outer bulb 3, whereby discharge vessel 2 is axially fixed inside outer bulb 3. Lead wires 20, 21 are connected with electrical terminals 24, 25 of plug-in base 19 by means of sealing foils 22, 23 of the foot and by means of other short current leads. A mica plate 26 arranged in socket 19 between terminals 24, 25 serves for electrical insulation.

The filling contains 60 mg of Hg and 22 kPa Ar as the basic gas. In addition, discharge vessel 2 contains the filling components listed in following Table 1 in the quantities given there in mass units. The molar quantities calculated therefrom as well as the corresponding values referring to the volume of the discharge vessel are indicated in Table 2.

The electrode distance and the volume of the discharge vessel amount to 4 mm and approximately 3.5 $cm^3$. The specific arc power and the arc-drop voltage amount to approximately 144 W per mm of arc length and 62 V. Table 3 shows the obtained light-technical values.

Based on the short electrode distance of only 4 mm as well as the small cesium component, a comparatively high brightness results with the obtained luminous flux of about 48 klm. In this way, the lamp is particularly predestined for an application in video projectors. The devitrification tendency is small, so that an average service life of more than 1000 h is reached.

The following comparison between two different fillings of the lamp of FIG. 1 illustrates one more time the advantageous effect of the invention. The filling quantities each time were selected in this example so that the devitrification tendency is the same for both fillings. In filling I, we are dealing with a filling without yttrium according to the state of the art. Filling II, on the other hand, is a filling according to the invention. Here, half of the original quantity of dysprosium is replaced by a molar equivalent quantity of yttrium. In addition, the filling quantity of cesium is reduced by one half in comparison to filling I. As Table 4 shows, an approximately 4% higher luminous flux (Φ) as well as an approximately 17% higher brightness (L) is obtained with filling II according to the invention.

TABLE 1

Metal-halide composition of the lamp of FIG. 1.

| Component | Quantity in mg |
|---|---|
| CsI | 0.4 |
| TlI | 0.25 |
| Dy | 0.21 |
| Y | 0.11 |
| Hf | 0.14 |
| $HgI_2$ | 2.6 |
| $HgBr_2$ | 3.4 |

TABLE 2

Molar quantities of the most important filling components of Table 1.

| Component | Quantity in μmole | Quantity in μmole/$cm^3$ |
|---|---|---|
| Cs | 1.54 | 0.440 |
| Tl | 0.75 | 0.216 |
| Dy | 1.29 | 0.369 |
| Y | 1.24 | 0.354 |
| Hf | 0.78 | 0.224 |

TABLE 3

Light-technical values obtained with the filling of Table 1

| | |
|---|---|
| Luminous flux in lm | 48000 |
| Luminous Efficacy in lm/W | 84 |
| Color temperature in K | 6000 |
| $R_a$ | 85 |
| $R_9$ | >50 |
| Service life in h | >1000 |

TABLE 4

Comparison of the light-technical values obtained with two different fillings and the lamp in FIG. 1

| | Filling I (State of the art) | Filling II (Invention) |
|---|---|---|
| Dy in μmole | 1 | 0.5 |
| Y in μmole | — | 0.5 |
| Cs in μmole | 1.2 | 0.6 |
| in klm | 47 | 49 |
| L in ked/$cm^2$ | 30 | 35 |

While there have been shown and described what are at present considered the preferred embodiments of the invention, it will be apparent to those skilled in the art that various changes and modifications can be made herein without departing from the scope of the invention as defined by the appended claims.

What is claimed is:

1. A metal-halide high-pressure discharge lamp comprising: a discharge vessel having a cavity; two electrodes operatively positioned within said cavity; and an ionizable filling within said cavity, said filling comprising at least one inert gas, mercury, at least one halogen, and the following elements for the formation of halides: thallium, hafnium, whereby hafnium can be wholly or partially replaced by zirconium, and a rare earth metal selected from the group consisting of dysprosium and/or gadolinium, said fill further including yttrium.

2. The lamp according to claim 1 wherein the molar ratio between yttrium and the rare-earth metal(s) lies in the range $0.5<Y/RE<2$.

3. The lamp according to claim 2 wherein said molar ratio between yttrium and the rare-earth metal(s) is one.

4. The lamp according claim 1 or 2 or 3 wherein said filling contains a quantity of dysprosium up to 30 $\mu$moles per $cm^3$ of the volume of said cavity of said discharge vessel.

5. The lamp according to claim 1 wherein said filling contains a quantity of gadolinium in the range between 0 $\mu$mole and 0.6 $\mu$mole per $cm^3$ of the volume of said cavity of said discharge vessel.

6. The lamp according to claim 1 wherein said filling contains up to 30 $\mu$moles of cesium per $cm^3$ of the volume of the cavity of said discharge vessel.

7. The lamp according to claim 1 wherein said filling contains a quantity of thallium up to 15 $\mu$moles per $cm^3$ of the volume of the cavity of said discharge vessel.

8. The lamp according to claim 1 wherein said filling contains hafnium and/or zirconium in the range between 0.005 $\mu$mole and 35 $\mu$moles per $cm^3$ of the volume of the cavity of said discharge vessel.

9. The lamp according to claim 1 wherein said electrodes of said discharge vessel define therebetween a given arc length and said lamp operates with a specific arc power of about 80 to 120 W per mm of said given arc length.

10. The lamp according to claim 1 wherein said halogens are selected from the group consisting of iodine and/or bromine.

11. The lamp according to claim 1 wherein said discharge vessel is arranged inside an outer bulb having a base on at least one end thereof.

* * * * *